US006534931B1

(12) United States Patent
Konopka et al.

(10) Patent No.: US 6,534,931 B1
(45) Date of Patent: Mar. 18, 2003

(54) DIMMING CONTROL SYSTEM FOR ELECTRONIC BALLASTS

(75) Inventors: John G. Konopka, Deer Park, IL (US); Sameer Sodhi, Palatine, IL (US)

(73) Assignee: Osram Sylvania Inc., Danvers, MA (US)

( * ) Notice: Subject to any disclaimer, the term of this patent is extended or adjusted under 35 U.S.C. 154(b) by 20 days.

(21) Appl. No.: 09/966,911

(22) Filed: Sep. 28, 2001

(51) Int. Cl.[7] ..... H05B 37/02
(52) U.S. Cl. ..... 315/291; 315/294; 315/207
(58) Field of Search ..... 315/224, 225, 315/244, 247, 307, 308, 291–296, DIG. 4, 207

(56) References Cited

U.S. PATENT DOCUMENTS 6,300,727 B1 * 10/2001 Bryde et al. ..... 315/294
6,346,778 B1 * 2/2002 Mason et al. ..... 315/291
6,380,696 B1 * 4/2002 Sembhi et al. ..... 315/294

* cited by examiner

*Primary Examiner*—Don Wong
*Assistant Examiner*—Wilson Lee
(74) *Attorney, Agent, or Firm*—Kenneth D. Labudda

(57) ABSTRACT

A dimming control system includes a first circuit (100) and a second circuit (200). First circuit (100) is coupled in series with the AC line source (10) and receives brighten and dim commands from a user. The brighten and dim commands are communicated to second circuit (200) by momentarily altering the AC voltage waveforms observed by second circuit (200). Second circuit (200) provides an adjustable dimming control voltage that is coupled to existing dimming control circuitry within an electronic dimming ballast. The dimming control voltage is adjusted by the second circuit (200) in dependence on the observed AC voltage waveforms.

24 Claims, 2 Drawing Sheets

DIMMING CONTROL SYSTEM FOR ELECTRONIC BALLASTS

FIELD OF THE INVENTION

The present invention relates to the general subject of circuits for powering discharge lamps. More particularly, the present invention relates to a dimming control system for electronic ballasts.

BACKGROUND OF THE INVENTION

Conventional dimming ballasts for gas discharge lamps include low voltage dimming circuitry that is intended to work in conjunction with an external dimming controller. The external dimming controller is connected to special inputs on the ballast via dedicated low voltage control wiring that, for safety reasons, cannot be routed in the same conduit as the AC power wiring. The external dimming controller is usually very expensive. Moreover, installation of low voltage control wiring is quite labor-intensive (and thus costly), especially in "retrofit" applications. Because of these disadvantages, considerable efforts have been directed to developing control circuits that can be inserted in series with the AC line, between the AC source and the ballast(s), thereby avoiding the need for additional dimming control wires. The resulting approaches are sometimes broadly referred to as "line control" dimming.

A number of line control dimming approaches exist in the prior art. One known type of line control dimming approach involves introducing a notch (i.e., dead-time) into the AC voltage waveform at or near its zero crossings. This approach requires a switching device, such as a triac, in order to create the notch. Inside of the ballast(s), a control circuit measures the time duration of the notch and generates a corresponding dimming control signal for varying the light level produced by the ballast. In practice, these approaches have a number of drawbacks in cost and performance. A significant amount of power is dissipated in the switching device, particularly when multiple ballasts are to be controlled. Further, the method itself distorts the line current, resulting in poor power factor and high harmonic distortion, and sometimes produces excessive electromagnetic interference. Additionally, the control circuitry tends to be quite complex and expensive.

What is needed, therefore, is a dimming control system that avoids any need for additional dimming control wires, but that does so without introducing undesirable levels of steady-state power dissipation, line current distortion, or electromagnetic interference. A need also exists for a dimming control system that is structurally efficient and cost-effective. A dimming control system with these features would represent a significant advance over the prior art.

DETAILED DESCRIPTION OF THE PREFERRED EMBODIMENTS

Figure 1:
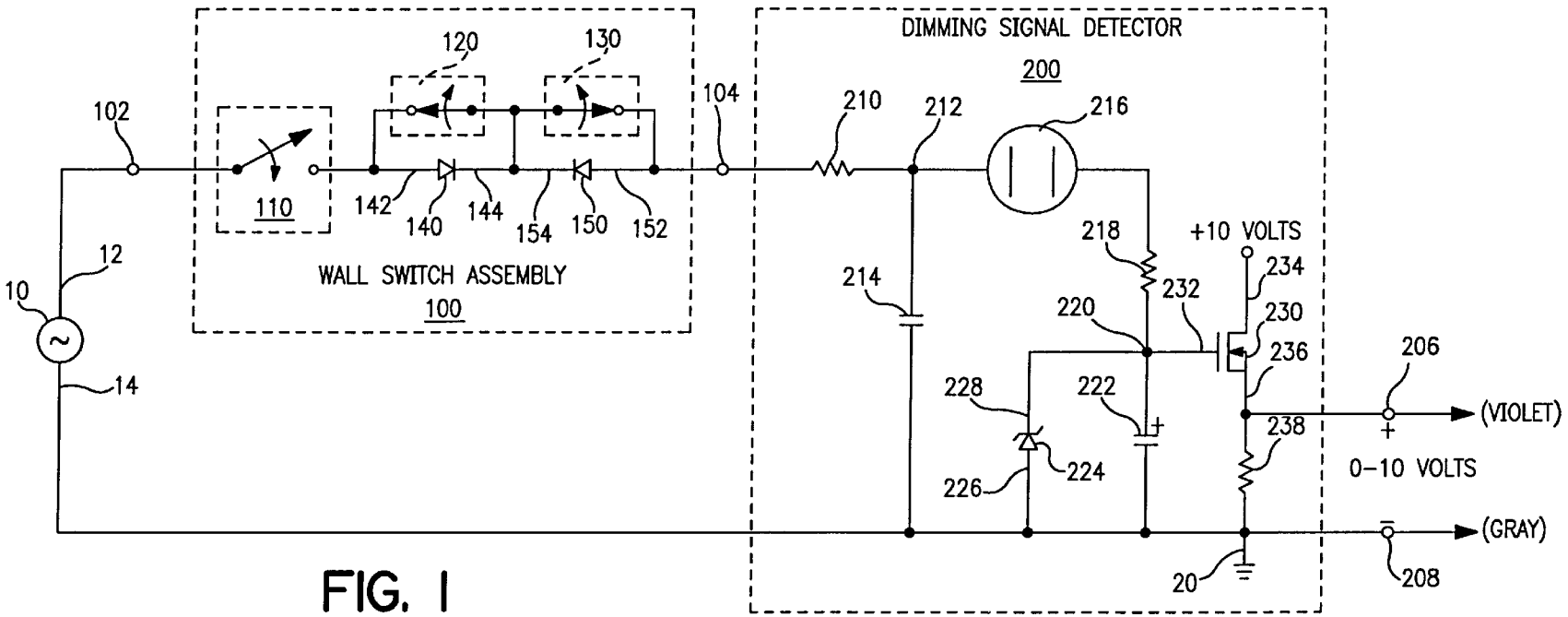
FIG. 1 describes a dimming control system for use in conjunction with one or more electronic dimming ballasts, in accordance with a first preferred embodiment of the present invention.

In a first preferred embodiment of the present invention, as described in FIG. 1, a dimming control system comprises a wall switch assembly 100 and a dimming signal detector 200. Wall switch assembly 100 has a first end 102 and a second end 104. Wall switch assembly 100 is intended for connection in series with a conventional alternating current (AC) source 10 (e.g., 120 volts at 60 hertz) having a hot lead 12 and a neutral lead 14. First end 102 is coupled to the hot lead 12 of AC source 10. Dimming signal detector 200 is coupled to second end 104 and the neutral lead 14 of AC source 10, and includes first and second outputs 206,208 for connection to low-voltage dimming circuitry in an electronic dimming ballast (not shown). Preferably, dimming signal detector 200 is itself situated within an electronic dimming ballast, and each ballast has its own detector 200. Wall switch assembly 100, on the other hand, is intended to be situated external to the ballast, and preferably within an electrical switchbox.

Wall switch assembly 100 includes a first switch 120, a second switch 130, a first diode 140, and a second diode 150. Wall switch assembly 110 may also include a conventional on-off switch 110 for controlling application of AC power to at least one ballast connected downstream from wall switch assembly 100. First diode 140 has an anode 142 and a cathode 144; anode 142 is coupled to first end 102 via on-off switch 110. Second diode 150 has an anode 152 and a cathode 154; anode 152 is coupled to second end 104, and cathode 154 is coupled to cathode 144 of diode 140. Switch 120 is coupled in parallel with diode 140, while switch 130 is coupled in parallel with diode 150.

Switches 120,130 are preferably implemented as single-pole single-throw (SPST) switches that are normally closed and that will remain open for only as long as they are depressed by a user. Moreover, it is desirable that switches 120,130 be mechanically "ganged" so as to preclude the possibility of both switches being open at the same time. Preferably, switches 120,130 share a single three-position control lever with an up-down action wherein an up motion would open switch 120, a down motion would open switch 130, and both switches 120,130 would be closed at rest. For example, switches 120,130 may be realized via an "up arrow/down arrow" rocker type arrangement, where switch 120 is opened while the "up arrow" is depressed, switch 130 is opened while the "down arrow" is depressed, and both switches 120,130 are closed in the absence of any depression by a user.

During operation, when on-off switch 110 is in the on position, wall switch assembly 100 behaves as follows.

When both switches 120,130 are closed, diodes 140,150 are each bypassed by their respective switch, so first end 102 is simply shorted to second end 104. Thus, both the positive and the negative half cycles of the voltage from AC source 10 are allowed to pass through, and the voltage between second end 104 and neutral lead 14, which is the voltage monitored by dimming signal detector 200 and supplied as AC power to the ballast circuitry, is a normal sinusoidal AC voltage.

When switch 120 is open and switch 130 is closed, positive-going current is allowed to proceed (from left to right) into first end 102, through diode 140, through switch 130 (bypassing diode 150, which blocks positive-going current), and out of second end 104. Conversely, negative-going current is blocked by diode 140. Thus, only the positive half-cycles of the AC voltage are allowed to pass through, and the voltage between second end 104 and neutral lead 14 is a half-wave rectified AC voltage that includes only the positive-going portions of the sinusoidal AC voltage from AC source 10.

When switch 120 is closed and switch 130 is open, negative-going current is allowed to proceed (from right to left) into second end 104, through diode 150, through switch 120 (thus bypassing diode 140, which blocks negative-going current), and out of first end 102. Conversely, positive-going current is blocked by diode 150. Thus, only the negative half-cycles of the AC voltage are allowed to pass through, and the voltage between second end 104 and neutral lead 14 is a half-wave rectified AC voltage that includes only the negative-going portions of the sinusoidal voltage from AC source 10.

As will be explained in further detail below, dimming signal detector 200 treats a momentary depression of switch 130 (i.e., only positive half-cycles allowed to pass) as a "brighten" command and responds by increasing the level of its output voltage (i.e., the voltage between output 206 and output 208) during the time that switch 130 remains depressed. Conversely, a momentary depression of switch 120 (i.e., only negative half-cycles allowed to pass) is treated as a "dim" command, to which dimming signal detector 200 responds by decreasing the level of its output voltage.

In contrast with prior art "line control" dimming approaches, such as those that employ a triac in series with the AC source, wall switch assembly 100 introduces no line-conducted electromagnetic interference (EMI) or distortion in the AC line current during normal operation (i.e., when switches 120,130 are closed). Moreover, wall switch assembly 100 dissipates no power during normal operation because the AC current drawn by any ballast(s) connected downstream flows through switches 120,130 rather than diodes 140,150. On the other hand, when one of the switches 120,130 is opened in order to send a dimming signal, a small amount of power will be dissipated in one of the diodes 140,150, but only for as long as the switch remains depressed. The required power rating of the diodes is a function of the power that will be drawn by the ballast(s) connected downstream.

Referring again to FIG. 1, in a first preferred embodiment of the present invention, dimming signal detector 200 includes first and second output terminals 206,208, a first resistor 210, a first capacitor 214, a neon lamp 216, a second resistor 218, a second capacitor 222, a zener diode 224, a transistor 230, and a third resistor 238. As alluded to previously, output terminals 206,208 are intended for connection to low voltage dimming circuitry in an electronic dimming ballast, such as that which is disclosed in U.S. Pat. No. 5,457,360, the pertinent disclosure of which is incorporated herein by reference. Preferably, dimming signal detector 200 provides a low voltage DC signal between output terminals 206,208 that can be varied between approximately zero and approximately 10 volts, wherein zero volts corresponds to minimum light output and 10 volts corresponds to maximum light output. It should be understood that output terminals 206,208 are parenthetically labeled "VIOLET" and "GRAY", respectively, merely in order to clarify their intended internal connection to ballasts that employ that color coding scheme for the low voltage control wires from dedicated dimming controllers; as mentioned above, it is fully contemplated that dimming signal detector 200 be physically situated within the ballast itself (i.e., no external wires are needed for connecting outputs 206,208 to the existing dimming circuitry within the ballast).

As illustrated in FIG. 1, first resistor 210 is coupled between the second end of wall switch assembly 100 and a first node 212. First capacitor 214 is coupled between first node 212 and a circuit ground node 20, the latter being coupled to the neutral lead 14 of AC source 10. The series combination of neon lamp 216 and second resistor 218 is coupled between first node 212 and second node 220. Second capacitor 222 is coupled between second node 220 and circuit ground 20. Zener diode 224 has an anode 226 coupled to circuit ground 20, and a cathode 228 coupled to second node 220. Transistor 230 is preferably implemented as a field-effect transistor (FET) having a gate 232, a drain 234, and a source 235. Gate 232 is coupled to second node 220. Drain 234 is coupled to a DC biasing voltage (e.g., +10 volts). Source 236 is coupled to first output terminal 206. Finally, third resistor 238 is coupled between first output terminal 206 and second output terminal 208, the latter of which is coupled to circuit ground 20.

In a prototype system configured substantially as shown in FIG. 1, dimming signal detector 200 was realized with the following component values:

Resistor 210: 100 kilohms
Capacitor 214: 0.1 microfarad
Resistor 218: 47 kilohms
Capacitor 222: 47 microfarads
Zener diode 224: $V_Z$=14 volts
Transistor 230: 2N7000
Resistor 238: 1 kilohm The detailed operation of dimming signal detector 200 is now explained with reference to FIG. 1 as follows.

During normal operation, when both switches 120,130 are closed, the voltage at node 212 (with respect to the circuit ground 20) is a low value AC voltage having a peak value well below that which is necessary to fire neon lamp 216; prior to firing, neon lamp 216 effectively behaves as an open circuit.

If switch 120 is momentarily opened (corresponding to a "brighten" command wherein only positive half-cycles are passed to second end 104), the voltage across capacitor 214 begins to increase in a positive direction and at a rate governed by its capacitance and the resistance of resistor 210. The voltage across capacitor 214 will rapidly reach the firing potential of neon lamp 216, causing the lamp 216 to conduct. With neon lamp 216 now on, capacitor 222 begins to charge up at a rate governed by its capacitance and the resistance of resistor 218. The voltage across capacitor 222 causes FET 230 to operate and a voltage develops between output terminals 206,208. Because FET 230, resistor 238, and output terminals 206,208 are configured in a manner analogous to an "emitter follower" arrangement, the voltage that develops between output terminals 206,208 is a function of the voltage across capacitor 222.

As switch 120 remains depressed, the voltage across capacitor 222 continues to rise, as does the voltage between output terminals 206,208. If switch 120 remains depressed for a predetermined period of time (e.g., 2 seconds or more), the voltage across capacitor will continue to rise until it reaches the zener voltage of zener diode 224, at which point zener diode 224 will become conductive and prevent any further increase in the voltage across capacitor 222. At this point, the voltage between output terminals 206,208 is approximately 10 volts, which corresponds to a full light output setting.

When switch 120 is released and allowed to return to its normally closed position, the voltage at second end 104 returns to its normal sinusoidal state. Consequently, the voltage across capacitor 214 drops well below the value necessary to maintain conduction of neon lamp 216, so lamp 216 turns off and charging current ceases to be supplied to capacitor 222. The voltage across capacitor 222 does not fall very rapidly and will remain at or near its charged voltage (i.e., the voltage across it when switch 120 was first released) for a considerable period of time. This "memory" capability is highly desirable in dimming applications, and is attributable to the fact that, while capacitor 222 has a leakage current, FET 230 continues to draw only a very small current (due to the very low gate-to-source leakage of the FET, which is typically on the order a few nanoamperes). The leakage current of capacitor 222 may be greatly reduced (and the "memory" effect enhanced) by implementing capacitor 222 as an ultra-low leakage capacitor (e.g., a polycarbonate capacitor). For example, it is believed that dimming signal detector 200 may be implemented such that the voltage across capacitor 222 will decrease by only 10% of its initial value over a 10 hour period. Alternatively, even a more modest "memory" capability (e.g., where the voltage across capacitor 222 decreases by, say, 50% over a 10 hour period) may constitute an attractive operational benefit; inasmuch as it is commonplace for occupants to leave a room without turning off the lights, this type of "automatic dimming" behavior can provide a substantial savings in electrical energy without constituting a nuisance to users.

If switch 130 is momentarily opened (corresponding to a "dim" command wherein only negative half-cycles are passed to second end 104), the voltage across capacitor 214 begins to increase in a negative direction and at a rate governed by its capacitance and the resistance of resistor 210. The voltage across capacitor 214 will rapidly reach the firing potential of neon lamp 216, causing the lamp 216 to conduct. With neon lamp 216 now on, the voltage across capacitor 222 (which was previously at a relatively high value of, say, 8 volts) begins to decrease. Correspondingly, the voltage between output terminals 206,208 decreases as well, thus effectuating the desired dimming in the ballast(s).

As switch 130 remains depressed, the voltage across capacitor 222 continues to fall, as does the voltage between output terminals 206,208. If switch 120 remains depressed for a predetermined period of time (e.g., 2 seconds or more), the voltage across capacitor will continue to fall until it reaches about −0.6 volts, at which point zener diode 224 will become forward biased and prevent any further negative increase in the voltage across capacitor 222. At this point, the voltage between output terminals 206,208 is approximately zero volts, which corresponds to a minimum light output setting.

When switch 130 is released and allowed to return to its normally closed position, the voltage at second end 104 returns to its normal sinusoidal state. Consequently, the voltage across capacitor 214 drops well below the value necessary to maintain conduction of neon lamp 216, so lamp 216 turns off and charging current ceases to be supplied to capacitor 222. The voltage between output terminals 206, 208 will then remain at or near zero (correspondingly, the lamps will be operated as minimum light output) until such time as a "brighten" command is sent. In this way, wall switch assembly 100 and dimming signal detector 200 provide a variable dimming control voltage for one or more dimming ballasts.

Figure 2:
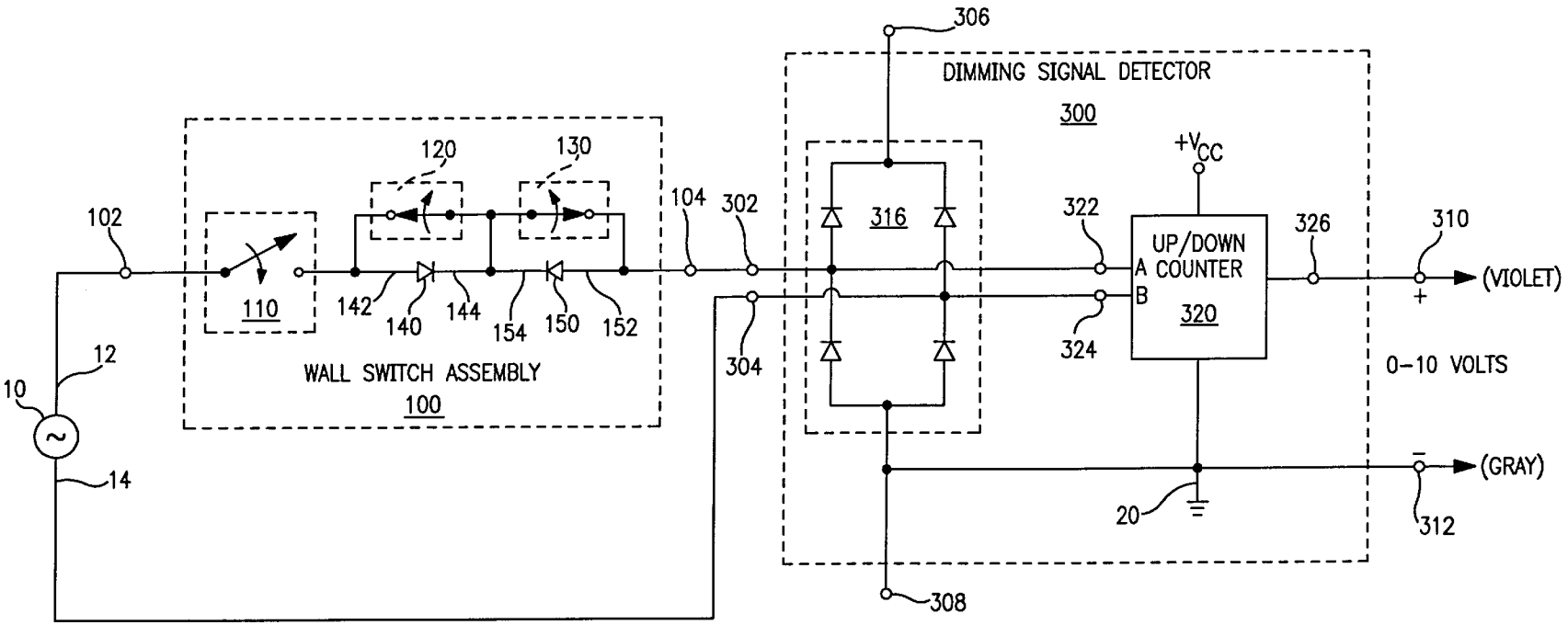
FIG. 2 describes a dimming control system for use in conjunction with one or more electronic dimming ballasts, in accordance with a second preferred embodiment of the present invention.

Turning now to FIG. 2, in a second preferred embodiment of the present invention, a dimming control system comprises a wall switch assembly 100 and a dimming signal detector 300. Wall switch assembly 100 is identical to that which was previously described with reference to FIG. 1. However, dimming signal detector 300 is appreciably different from that which was described in the first preferred embodiment.

Preferably, dimming signal detector 300 is itself situated within an electronic dimming ballast. If multiple dimming ballasts are involved, each ballast will have its own dimming signal detector 300; on the other hand, only one wall switch assembly 100 is required even if a plurality of ballasts are involved.

As described in FIG. 2, dimming signal detector 300 comprises first and second input terminals 302,304, first and second output terminals 310,312, a full-wave bridge rectifier 316, and an up-down counter 320. First input terminal 302 is coupled to second end 104 of wall switch assembly 100. Second input terminal 304 is coupled to the neutral lead 14 of AC source 10. Output terminals 310,312 are adapted for internal connection to the low voltage dimming control inputs of an electronic dimming ballast. Second output terminal 312 is coupled to circuit ground 20.

Although full-wave bridge rectifier 316 is already provided within each electronic dimming ballast, it is explicitly shown and described herein for the sake of clarity and to aid in understanding the detailed operation of dimming signal detector 300. Full-wave bridge rectifier 316 is coupled to input terminals 302,304 and circuit ground 20. Rectifier 316 includes output connections 306,308 that are intended for connection with, for example, a power factor correction stage (e.g., a boost converter) within the electronic dimming ballast; during normal operation, when both switches 120, 130 are closed, the voltage between terminal 306 and terminal 308 is unfiltered, full-wave rectified AC. Output connection 308 is coupled to circuit ground 20, and thus provides a ground reference (which is at a different potential than neutral lead 14 of AC source 10) that is important to the desired operation of dimming signal detector 300.

Up-down counter 320 includes a first counter input 322, a second counter input 324, and a counter output 326. First counter input 322 is coupled to full-wave rectifier 316 and input terminal 302. Second counter input 324 is coupled to full-wave rectifier 316 and input terminal 304. Counter output 326 is coupled first output terminal 310. Up-down counter 320 receives operating power from a DC supply ($+V_{CC}$). In one realization, up-down counter 320 preferably includes a digital counter followed by a digital-to-analog (D/A) converter, as well as any associated peripheral circuitry (e.g., resistive voltage divider networks associated with each counter input in order to scale the voltages down to manageable levels for the digital counter). Alternatively, up/down counter may be implemented via a custom integrated circuit or a programmable microcontroller.

During operation, up/down counter 320 monitors the signals at input terminals 302,304 (both of which are taken with respect to circuit ground 20, which is at a different potential than the neutral lead 14 of AC source 10) and increases or decreases the voltage between output terminals 310,312 in response to an "imbalance" between the signals at input terminals 302,304. More specifically, up/down counter 320 counts up by one for each positive half-cycle that appears at first counter input 322, and counts down by one for each positive half-cycle that appears at second counter input 324. The count is internally converted by a D/A converter to a voltage that is provided at counter output 326.

During normal operation, when both switches 120,130 are closed, an equal number of positive half-cycles occur at each of the counter inputs 322,324 over a fixed period of time, so the internal count (and, correspondingly, the voltage between output terminals 310,312) remains stable. Nevertheless, it should be appreciated that the count continuously moves up and down by one count (at the frequency of AC source 10—e.g., 60 hertz) because, at any given instant in time, only one of the inputs 322,324 sees a positive half-cycle while the other does not. More specifically, during each positive half-cycle of the voltage from AC source 10, counter input 322 is high while counter input 324 is low, causing the count to be incremented by one; conversely, during each negative half-cycles of the voltage from AC source 10, counter input 322 is low while counter input 324 is high, causing the count to be decremented by one. Thus, during normal operation when both switches 120,130 are closed, the count "dithers" up and down by one; correspondingly, the voltage between output terminals 310, 312 will also dither. In order to ensure that this low frequency dithering effect does not introduce excessive flicker in the lamps, it is necessary that the counter be configured to provide a suitably high counting range (e.g., 0 to 127, which is realizable with an 8-bit counter) such that a variation of one in the count, which is less than 1% of the maximum count, does not produce noticeable or annoying flicker in the lamps.

If switch 120 is momentarily opened, counter input 322 will be high during the next positive half-cycle of AC source 10, and counter input 324 will be low. Counter 320 will increment the count by one for each AC line cycle that occurs while switch 120 is open, and will continue to do so (up to a predetermined maximum count) until switch 120 is allowed to close. The increased count is translated, via the D/A converter internal to counter 320, into an increased voltage at counter output 326, corresponding to an increased voltage between output terminals 310,312.

As switch 120 remains depressed, counter 320 will continue to increment the count by one for each AC line cycle. If switch 120 remains depressed long enough (e.g., 2 seconds), the count will reach its predetermined maximum count (e.g., 127, if an 8-bit counter is employed), which corresponds to a maximum value (e.g., 10 volts) for the voltage between output terminals 310,312.

When switch 120 is released and allowed to return to its normally closed position, the signals at counter inputs 322, 324 return to their normal operating condition (i.e., each sees a high signal during its respective half-cycle of the AC line) and the count and output voltage are maintained at their maximum values (subject to the slight dithering previously discussed) until such time as a dim command is sent by depression of switch 130.

If switch 130 is momentarily opened, counter input 322 will be low and counter input 324 will be high. Counter 320 will decrement the count by one for each AC line cycle that occurs while switch 130 is open, and will continue to do so (down to the minimum count of zero) until switch 130 is allowed to close. The decreased count is translated, via the D/A converter internal to counter 320, into a decreased voltage at counter output 326, which corresponds to a decreased voltage between output terminals 310,312.

As switch 130 remains depressed, counter 320 will continue to decrement the count by one for each AC line cycle. If switch 130 remains depressed long enough (e.g., 2 seconds), the count will reach its predetermined minimum count of zero, which corresponds to a minimum value (e.g., zero volts) for the voltage between output terminals 310, 312.

When switch 130 is released and allowed to return to its normally closed position, the signals at counter inputs 322, 324 return to their normal operating condition (i.e., each sees a high signal during its respective half-cycle of the AC line) and the count and output voltage are maintained at their minimum values (subject to the slight dithering previously discussed) until such time as a brighten command is sent by depression of switch 120.

In this way, wall switch assembly 100 and dimming signal detector 300 provide a variable dimming control voltage for one or more electronic dimming ballasts.

Although the present invention has been described with reference to certain preferred embodiments, numerous modifications and variations can be made by those skilled in the art without departing from the novel spirit and scope of this invention.

What is claimed is:

1. An arrangement, comprising:

a first circuit having a first end and a second end, wherein the first end is coupled to a hot lead of a source of alternating current (AC) voltage, the first circuit being operable to receive a first user command and a second user command, and to provide:

(i) in the absence of a user command, a normal operating mode wherein the first end is electrically shorted to the second end;

(ii) in response to the first user command, a brighten mode wherein only a positive-going current is allowed to flow from the first end to the second end; and (iii) in response to the second user command, a dim mode wherein only a negative-going current is allowed to flow from the first end to the second end; and a second circuit coupled between the second end of the first circuit and a neutral lead of the source of AC voltage, the second circuit having first and second output terminals adapted for connection to dimming control circuitry within an electronic dimming ballast operable to set an illumination level of a lamp in dependence on a dimming control voltage, the second circuit being operable to provide the dimming control voltage between the first and second output terminals in dependence on the user commands received by the first circuit.

2. The arrangement of claim 1, wherein the dimming control voltage is:

(i) increased in response to the first user command; and (ii) decreased in response to the second user command.

3. The arrangement of claim 2, wherein:

the increase in the dimming control voltage is dependent on the duration of the first user command; and the decrease in the dimming control voltage is dependent on the duration of the second user command.

4. The arrangement of claim 1, wherein, in the absence of a user command during a ten hour period, the dimming control voltage varies by no more than ten percent during the ten hour period.

5. The arrangement of claim 1, wherein the first circuit further comprises:

a first rectifier having an anode and a cathode, wherein the anode is coupled to the first end;

a second rectifier having an anode coupled to the second end and a cathode coupled to the cathode of the first rectifier;

a first normally-closed switch coupled in parallel with the first rectifier; and a second normally-closed switch coupled in parallel with the second rectifier.

6. The arrangement of claim 5, wherein:

the first user command corresponds to opening the first normally-closed switch for a limited period of time; and the second user command corresponds to opening the second normally-closed switch for a limited period of time.

7. The arrangement of claim 1, wherein the second circuit further comprises:

a first resistor coupled between the second end of the first circuit and a first node;

a first capacitor coupled between the first node and a circuit ground, wherein the circuit ground is coupled to the second output terminal and the neutral lead of the source of AC voltage;

a neon lamp coupled to the first node;

a second resistor coupled between the neon lamp and a second node;

a second capacitor coupled between the second node and the circuit ground;

a zener diode having an anode coupled to circuit ground and a cathode coupled to the second node;

a transistor having a gate coupled to the second node, a drain coupled to a direct current (DC) biasing voltage, and a source coupled to the first output terminal; and a third resistor coupled between the first and second output terminals.

8. The arrangement of claim 5, wherein the second circuit further comprises:

a first resistor coupled between the second end of the first circuit and a first node;

a first capacitor coupled between the first node and a circuit ground, wherein the circuit ground is coupled to the second output terminal and the neutral lead of the source of AC voltage;

a neon lamp coupled to the first node;

a second resistor coupled between the neon lamp and a second node;

a second capacitor coupled between the second node and the circuit ground;

a zener diode having an anode coupled to circuit ground and a cathode coupled to the second node;

a transistor having a gate coupled to the second node, a drain coupled to a direct current (DC) biasing voltage, and a source coupled to the first output terminal; and a third resistor coupled between the first and second output terminals.

9. The arrangement of claim 1, wherein the first circuit is situated within an electrical switchbox in a building.

10. The arrangement of claim 1, wherein the second circuit is situated within the electronic dimming ballast.

11. A dimming control system, comprising:

a first circuit, comprising:

a first end coupled to a hot lead of a source of alternating current (AC) voltage;

a second end;

a first rectifier having an anode and a cathode, wherein the anode is coupled to the first end;

a second rectifier having an anode coupled to the second end and a cathode coupled to the cathode of the first rectifier;

a first normally-closed switch coupled in parallel with the first rectifier; and a second normally-closed switch coupled in parallel with the second rectifier; and a second circuit coupled between the second end of the first circuit and a neutral lead of the source of AC voltage, the second circuit having first and second output terminals adapted for connection to dimming control circuitry within an electronic dimming ballast operable to set an illumination level of a lamp in dependence on a dimming control voltage, the second circuit being operable to provide the dimming control voltage between the first and second output terminals in dependence on opening of the first and second normally-closed switches in first circuit.

12. The arrangement of claim 11, wherein the dimming control voltage is:

(i) increased in response to the first normally-closed switch being opened for a limited period of time; and (ii) decreased in response to the second normally-closed switch being opened for a limited period of time.

13. The arrangement of claim 12, wherein:

the increase in the dimming control voltage is dependent on the amount of time that the first normally-closed switch is open; and the decrease in the dimming control voltage is dependent on the amount of time that the second normally-closed switch is open.

14. The arrangement of claim 11, wherein the second circuit further comprises:

a first resistor coupled between the second end of the first circuit and a first node;

a first capacitor coupled between the first node and a circuit ground, wherein the circuit ground is coupled to the second output terminal and the neutral lead of the source of AC voltage;

a neon lamp coupled to the first node;

a second resistor coupled between the neon lamp and a second node;

a second capacitor coupled between the second node and the circuit ground;

a zener diode having an anode coupled to circuit ground and a cathode coupled to the second node;

a transistor having a gate coupled to the second node, a drain coupled to a direct current (DC) biasing voltage, and a source coupled to the first output terminal; and a third resistor coupled between the first and second output terminals.

15. A dimming control system, comprising:

a wall switch assembly, comprising:

a first end coupled to a hot lead of a source of alternating current (AC) voltage;

a second end;

a first rectifier having an anode and a cathode, wherein the anode is coupled to the first end;

a second rectifier having an anode coupled to the second end and a cathode coupled to the cathode of the first rectifier;

a first normally-closed switch coupled in parallel with the first rectifier; and a second normally-closed switch coupled in parallel with the second rectifier; and a dimming signal detector situated within an electronic dimming ballast, comprising:

first and second output terminals;

a first resistor coupled between the second end of the first circuit and a first node;

a first capacitor coupled between the first node and a circuit ground, wherein the circuit ground is coupled to the second output terminal and the neutral lead of the source of AC voltage;

a neon lamp coupled to the first node;

a second resistor coupled between the neon lamp and a second node;

a second capacitor coupled between the second node and the circuit ground;

a zener diode having an anode coupled to circuit ground and a cathode coupled to the second node;

a transistor having a gate coupled to the second node, a drain coupled to a direct current (DC) biasing voltage, and a source coupled to the first output terminal; and a third resistor coupled between the first and second output terminals.

16. An arrangement, comprising:

a first circuit having a first end and a second end, wherein the first end is coupled to a hot lead of a source of alternating current (AC) voltage, the first circuit being operable to receive a first user command and a second user command, and to provide:

(i) in the absence of a user command, a normal operating mode wherein the first end is electrically shorted to the second end;

(ii) in response to the first user command, a brighten mode wherein only a positive-going current is allowed to flow from the first end to the second end; and (iii) in response to the second user command, a dim mode wherein only a negative-going current is allowed to flow from the first end to the second end; and a second circuit having a first input terminal coupled to the second end of the first circuit and second input terminal coupled to a neutral lead of the source of AC voltage, the second circuit having first and second output terminals adapted for connection to dimming control circuitry within an electronic dimming ballast operable to set an illumination level of a lamp in dependence on a dimming control voltage, the second circuit being operable to provide the dimming control voltage between the first and second output terminals in dependence on the user commands received by the first circuit, wherein the dimming control voltage is:

(i) increased in response to the first user command being received by the first circuit; and (ii) decreased in response to the second user command being received by the first circuit.

17. The arrangement of claim 16, wherein:

the increase in the dimming control voltage is proportional to the duration of the first user command; and the decrease in the dimming control voltage is proportional to the duration of the second user command.

18. The arrangement of claim 16, wherein the first circuit further comprises:

a first rectifier having an anode and a cathode, wherein the anode is coupled to the first end;

a second rectifier having an anode coupled to the second end and a cathode coupled to the cathode of the first rectifier;

a first normally-closed switch coupled in parallel with the first rectifier; and a second normally-closed switch coupled in parallel with the second rectifier.

19. The arrangement of claim 18, wherein:

the first user command corresponds to opening the first normally-closed switch for a limited period of time; and the second user command corresponds to opening the second normally-closed switch for a limited period of time.

20. The arrangement of claim 16, wherein the second circuit further comprises:

a full-wave bridge coupled to the first and second input terminals, the full-wave bridge rectifier including first and second output connections, wherein the second output connection is coupled to a circuit ground and the second output terminal of the second circuit; and an up-down counter, comprising a first counter input coupled to the first input terminal, a second counter input coupled to the second input terminal, and a counter output coupled to the first output terminal, wherein the up-down counter has an internal count and is operable to:

(i) increment the count in response to the first user command; and (ii) decrement the count in response to the second user command.

21. The arrangement of claim 20, wherein the up-down counter further comprises a digital-to-analog converter for converting the count into a voltage provided between the first and second output terminals.

22. The arrangement of claim 18, wherein the second circuit further comprises:

a full-wave bridge coupled to the first and second input terminals, the full-wave bridge rectifier including first and second output connections, wherein the second output connection is coupled to a circuit ground and the second output terminal of the second circuit; and an up-down counter, comprising a first counter input coupled to the first input terminal, a second counter input coupled to the second input terminal, and a counter output coupled to the first output terminal, wherein the up-down counter has an internal count and is operable to:

(i) increment the count in response to the first user command; and (ii) decrement the count in response to the second user command.

23. The arrangement of claim 22, wherein the up-down counter further comprises a digital-to-analog converter for converting the count into a voltage provided between the first and second output terminals.

24. A dimming control system, comprising:

a wall switch assembly, comprising:

a first end coupled to a hot lead of a source of alternating current (AC) voltage;

a second end;

a first rectifier having an anode and a cathode, wherein the anode is coupled to the first end;

a second rectifier having an anode coupled to the second end and a cathode coupled to the cathode of the first rectifier;

a first normally-closed switch coupled in parallel with the first rectifier; and a second normally-closed switch coupled in parallel with the second rectifier; and a dimming signal detector, comprising:

a first input terminal coupled to the second end of the wall switch assembly;

a second input terminal coupled to a neutral lead of the source of AC voltage;

first and second output terminals adapted for connection to dimming control circuitry within an electronic dimming ballast operable to set an illumination level of a lamp in dependence on a dimming control voltage;

a full-wave bridge coupled to the first and second input terminals, the full-wave bridge rectifier including first and second output connections, wherein the second output connection is coupled to a circuit ground and the second output terminal of the second circuit; and an up-down counter, comprising:

a first counter input coupled to the first input terminal;

a second counter input coupled to the second input terminal;

a counter output coupled to the first output terminal; and a digital-to-analog converter for converting the count into a voltage provided between the first and second output terminals.

* * * * *